United States Patent [19]

Orthuber

[11] 4,126,813

[45] Nov. 21, 1978

[54] DIRECT VIEW DEVICE

[75] Inventor: Richard K. Orthuber, Sepulveda, Calif.

[73] Assignee: International Telephone and Telegraph Corporation, Nutley, N.J.

[21] Appl. No.: 815,526

[22] Filed: Apr. 9, 1969

[51] Int. Cl.[2] ..... H01J 31/48; H01J 43/06

[52] U.S. Cl. ..... 315/11; 313/103 CM; 313/105 CM

[58] Field of Search ..... 313/103, 104, 105, 103 CM, 313/105 CM; 315/11, 15

[56] References Cited

U.S. PATENT DOCUMENTS

| | | | |
|---|---|---|---|
| 3,327,151 | 6/1967 | Adams et al. | 313/104 X |
| 3,387,137 | 6/1968 | Adams | 313/104 X |
| 3,436,590 | 4/1969 | Wolfgang et al. | 313/104 X |
| 3,458,745 | 7/1969 | Shoulders | 313/105 X |

*Primary Examiner*—Malcolm F. Hubler
*Attorney, Agent, or Firm*—John T. O'Halloran

[57] ABSTRACT

The invention includes an electron tube such as an image intensifier which utilizes a channel-type electron multiplier. The multipler is made of a perforated glass plate made in a manner such that secondary emission may be produced at the interior surfaces of the holes through the plate. Primary electrons are introduced to the holes at one end and a much larger emission emanates from the other end. Conductive layers on each side of the plate have holes in registration with the plate holes. The conductive layers are maintained at potentials to accelerate electron flow through the holes. In accordance with the present invention, a third conductive layer is provided at the output side. When the third conductive layer is maintained negative, resolution is improved.

9 Claims, 7 Drawing Figures

INVENTOR.
R. K. ORTHUBER
BY
ATTORNEY

INVENTOR.
R. K. ORTHUBER
BY
H. Donald Stotz
ATTORNEY

INVENTOR.
R. K. ORTHUBER
BY
ATTORNEY

INVENTOR.
R. K. ORTHUBER
BY
ATTORNEY

DIRECT VIEW DEVICE

BACKGROUND OF THE INVENTION

This invention relates to electron tubes and, more particularly, to a channel-type electron multiplier.

The invention will have many uses. Therefore, its scope of application is not to be limited to the uses specifically disclosed herein.

In the past, it has been the practice to use image intensifiers or image converters to aid night vision for military reconnaissance or the like. Such tubes employ a photocathode which supplies a channel-type electron multiplier with primary electrons. The multiplier includes a glass plate with holes therethrough which support secondary emission. Primary electrons enter a hole and bombard the internal surface of the hole. Then, secondary electrons are emitted which travel part way down the hole and bombard it again. Each time, the number of secondaries exceed the bombarding numbers; and electron multiplication occurs. Thus, the multiplier produces an electron output which is far higher than its input. The output is then directed onto a phosphor screen which produces an image of the scene being viewed. The image is displayed with a brightness considerably greater than the scene itself would appear to the naked eye.

Electrons are accelerated down the plate holes by an electric field. The field is created by the application of different potentials to a conductive layer on each side of the glass plate. Each layer has holes in registration with the plate holes.

Fair resolution is obtained by using a relatively large number of small multiplier holes located close together. Thus, the output of each hole supplies a piece of the image picture.

Manufacture of channel-type electron multipliers with good resolution is difficult because of the requirement for a large number of small holes. Further, resolution is thereby limited. There is thus a continuing demand for channel-type electron multipliers of improved resolution.

SUMMARY OF THE INVENTION

In accordance with the device of the present invention, the abovedescribed and other disadvantages of the prior art are overcome by providing an additional conductive sheet or the like for the multiplier. The sheet may be in the form of a third conductive layer similar to that on the output side of the glass plate. The third layer is then positioned adjacent the output layer but insulated therefrom. When the third layer is maintained negative with respect to the output layer, resolution is improved.

It is believed that slow electrons emanate from output end portions of the multiplier holes. It is further believed that the slow electrons spread on the phosphor screen and thereby degrade resolution. Thus, the negative third conductive layer apparently suppresses the slow electrons when it improves resolution.

The above-described and other advantages of the present invention will be better understood from the following description when considered in connection with the accompanying drawings.

BRIEF DESCRIPTION OF THE DRAWINGS

In the drawings, which are to be regarded as merely illustrative.

DESCRIPTION OF THE PREFERRED EMBODIMENT

It is known that the application of channel-type electron multipliers for the intensification of electron images in image intensifier tubes presents difficulties in projecting with minimum resolution loss the intensified electron image onto a closely spaced phosphor screen.

Figure 1:
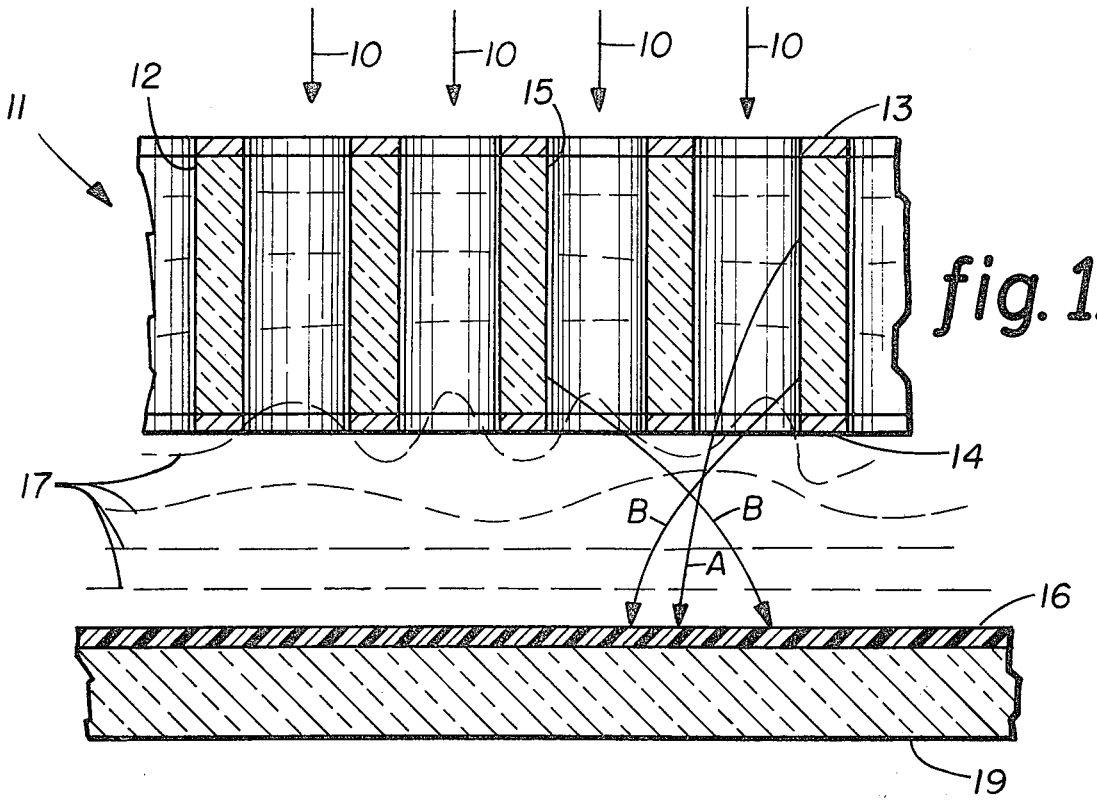
FIG. 1 is a greatly enlarged sectional view of a portion of a conventional intensifier tube.

FIG. 1 shows a conventional arrangement of an image intensifier, omitting the mechanism for producing the primary electron image. The electron image produced in conventional fashion impinges in the direction of arrows 10 on the upper surface of a channel-type electron multiplier 11. On the input surface and the output surface of a glass plate 12, conductive layers 13 and 14 are deposited (e.g., by metal evaporation), which serve to produce an electric field within the plate 12. This field accelerates electrons toward the output layer 14. Both layers 13 and 14 and plate 12 have holes which lie in registration with one another to form channels 15.

It is well known that in this way, a low density input electron current 10 can be intensified by many orders of magnitude in traversing channels of holes 15 in plate 12 by repeated electron impact on the channel walls in plate 12. This intensified electron current is, in the case of an image intensifier, accelerated onto a phosphor screen 16 which is held at a potential of, for example, +5000 volts on a transparent window 19.

In general, the potential difference between layers 13 and 14 is some five to ten times less than the phosphor voltage and the spacing between layer 14 and phosphor 16 is about one to two times the spacing between layers 13 and 14. Therefore, the average field within plate 12 is substantially less than the field between plate 12 and phosphor 16; but the field direction is the same in both regions. For example, layer 13 may be maintained at −1000 volts and layer 14 at zero volts when phosphor 16 is maintained at +5000 volts. This situation leads to field deformations as qualitatively indicated by dashed equipotential lines 17 showing field penetration into the channels.

The effect of electrostatic microlenses created at the output of multiplier 11 are different for electrons which originate deep in the channels (type A) than those which are released near the channel ends in the region of the fringe field (type B). The former, when reaching the fringe field, have reached considerable velocity and are, therefore, only slightly deflected by the transverse component of the electron lens field, whereas the latter acquire substantial transverse velocities near their points of origin. As a result, the former will strike the phosphor 16 much closer to the beam axis, whereas the latter will overlap the beams emitted by neighboring channels, thus degrading resolution.

Figure 2:
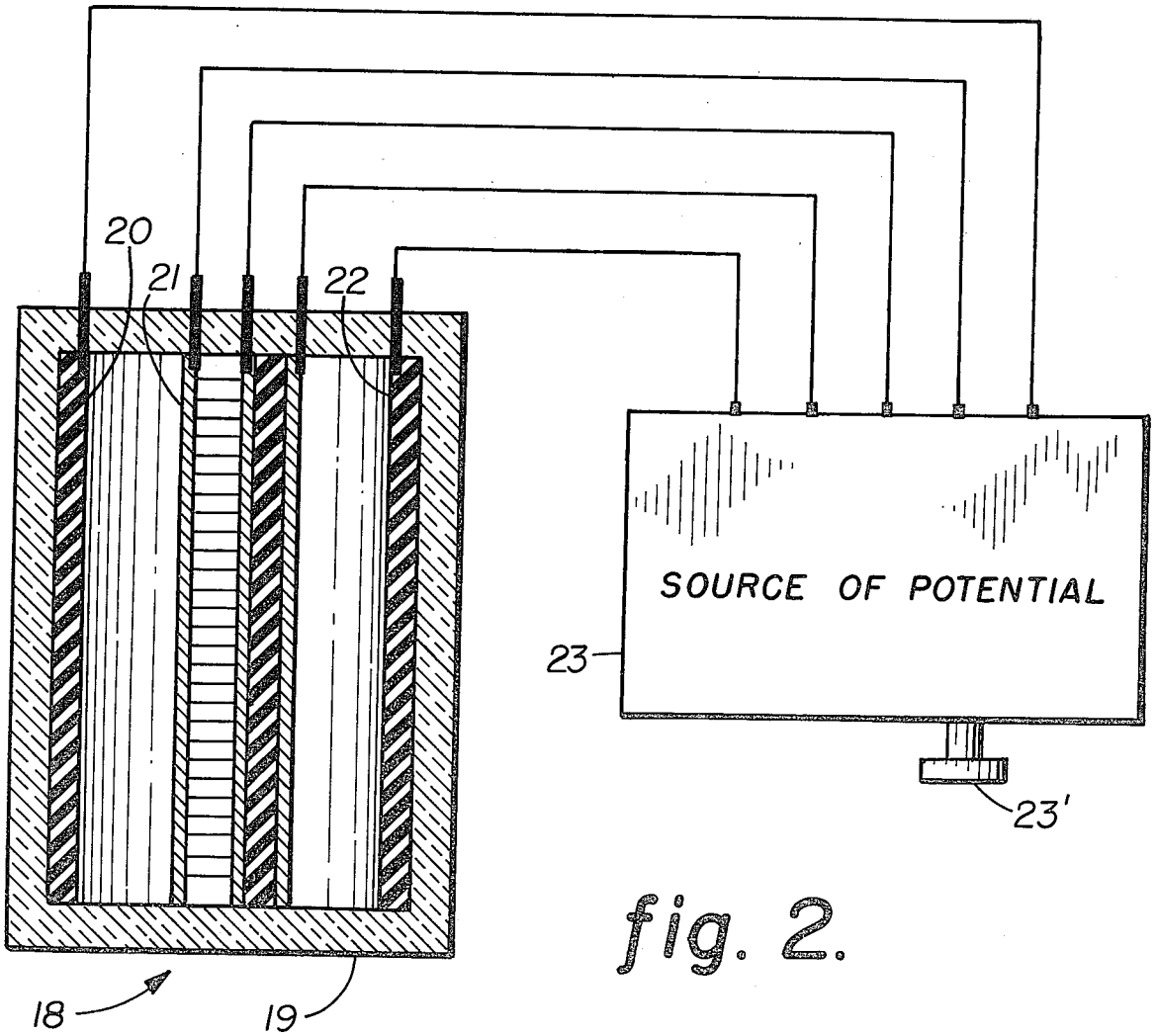
FIG. 2 is a schematic diagram of an image intensifier constructed in accordance with the present invention.

In accordance with the present invention, an image intensifier tube 18 shown in FIG. 2 is provided including an evacuated transparent envelope 19, a photocathode 20, and electron multiplier 21, and a phosphor screen 22. A source of potential 23 maintains the electrode elements of tube 18 at appropriate operating potentials. Source 23 can vary the potential of a control electrode 25 by adjustment of a knob 23'. Control electrode 25 as shown in FIG. 3 will be further described shortly.

Figure 3:
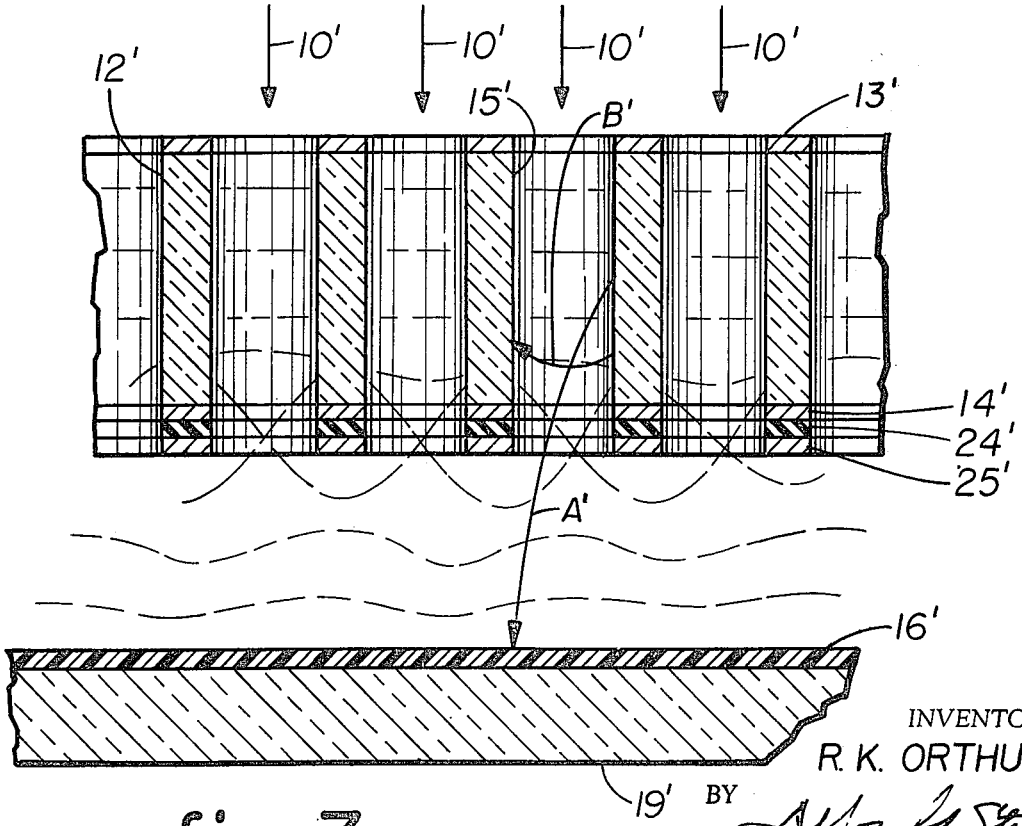
FIG. 3 is a greatly enlarged sectional view of a portion of the tube shown in FIG. 2.

A greatly enlarged sectional view of a portion of tube 18 is shown in FIG. 3. FIG. 3 shows an improved system of output electrodes. Here, arrows 10' and structures 12', 13', 14', 15', 16', and 19' are identical to arrows 10 and structures 12, 13, 14, 15, 16, and 19, respectively, in FIG. 1. An insulating or low conductance spacer layer 24 and a metallic control electrode 25 are deposited on the normal output electrode 14 at the output surface.

In operation, the potentials applied on layers 13', 14', and 15' are as in FIG. 1 namely:

−1000 volts to the input electrode 13';
0 volts to the output electrode 14'; and
+5000 volts to the phosphor 16'.

The control electrode 25 is preferably held at a potential adjustable between zero and approximately −100 volts. The layers 24 and 25 are very thin; and, thus, the application of zero volts to electrode 25 will lead to substantially the same situation as in FIG. 1.

By biasing the control electrode 25 somewhat negatively to make the highest potential on the axis inside the channel neglative also (say −K volts), the aperature will repel all slow electrons emitted from wall sections at potentials from between zero and −K volts but still will permit transmission of fast electrons emitted from wall sections at a negative potential nearer to −1000 volts than −K volts. Thus, negative biasing of electrode 25 makes the apertures act as electron mirrors for the slow (type B) electrons and as electrostatic lenses for the fast (type A) electrons, thus eliminating the resolution degrading slow electrons from the emitted beams.

The slow electrons being reflected back into the channels will be intercepted by the walls and, as far as current loading of the channels is concerned, the situation is as if they had not been emitted at all. Channel saturation is, therefore, only determined by the actually utilized fast electrons.

The application of the two additional layers 24 and 25 to the output surface is preferentially accomplished by evaporation of first an insulating (or poorly conductive) film of, e.g., SiO, followed by evaporation of a suitable metal such as aluminum, nickel, cooper, inconel, etc. In such a sequential evaporation process, it may be desirable to avoid the metal film from overlapping the insulating coating, thus shorting electrode 25 to electrode 14'. This difficulty can be avoided by proceeding according to FIG. 3.

Figure 4:
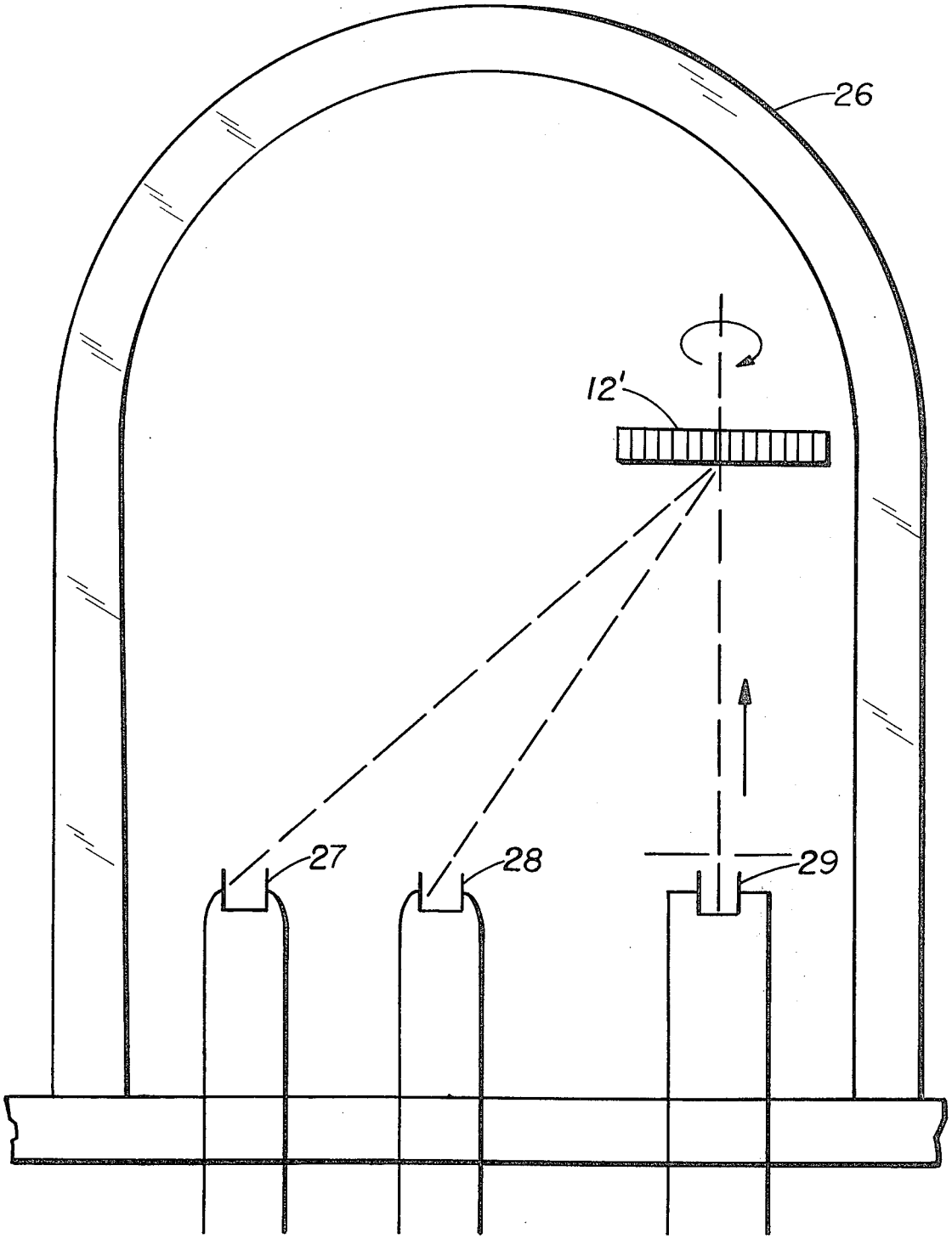
FIG. 4 is a diagrammatic view of apparatus which may be employed to fabricate an electron multiplier in accordance with the present invention.

FIG. 4 shows three evaporators 27, 28, and 29 (boats, filaments, etc.) mounted side-by-side under a bell jar 26. The evaporator 27 generates a metal vapor suitable for deposition of the conventional output electrode 14' (copper, nickel, etc.). The evaporator 28 generates a vapor, which after deposition, forms the insulating or semiconductive spacer layer 24 (e.g., $SiO$-$SiO_2$). The evaporator 29 generates the conductive control electrode 25. The plate 12' is arranged in a position such that the angle of incidence on its output surface is very small for the beam from source 29, larger (approximately 45°) from source 28, and still larger or nearly grazing from source 27. Besides, provisions are made that the plate 12' can be rotated during evaporation around an axis through its center and normal to its input and output surfaces.

Figure 5:
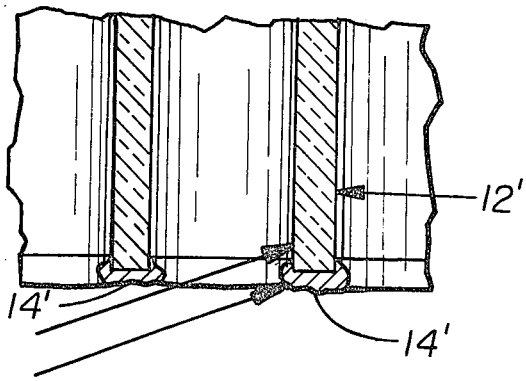
FIGS. 5, 6 and 7 are greatly enlarged sectional views of a portion of an electron multiplier illustrating certain fabrication steps.
Figure 6:
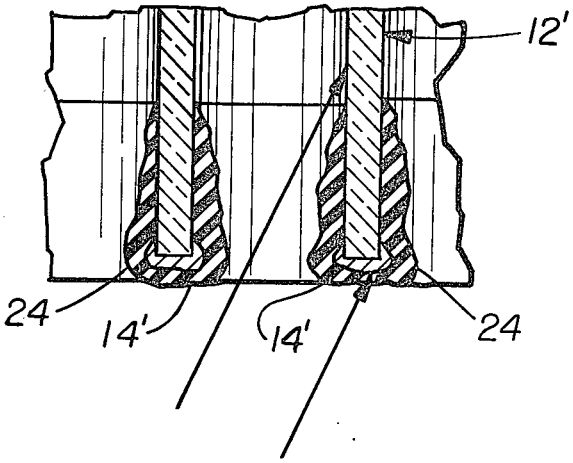
Figure 7:
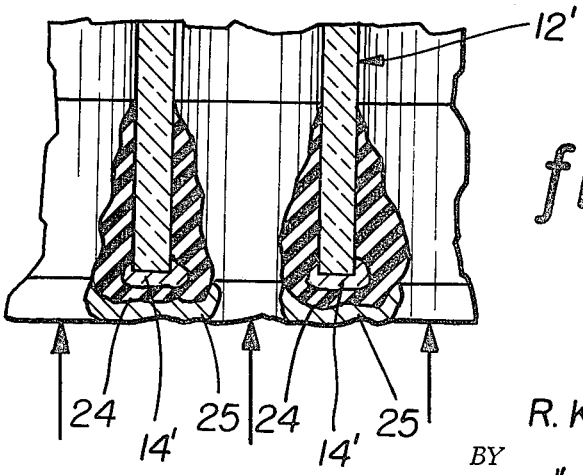

FIG. 5 shows qualitatively the resulting microgeometry of the layers. The first deposition provides the conventional output electrode 14'. If carried out under a near grazing angle, the coating will enter into the channels only to within a fraction of the channel diameter. The second evaporation providing the spacer layer 24 under 45° from source 28 will, due to the geometry selected, enter the channels to a maximum of one channel diameter. Shading by the channel aperture will cause the thickness of coating to increase from this depth toward the exit aperture of the channel, where the thickness will become equal to the thickness of coating 24 on the flat surface of the plate.

The third evaporation providing conductive electrode 25 is performed normal to the surface. Due to the overhang of layer 24, the insulating sleeve of 24 inside the channels is protected from the vapor forming 25; and shorting of electrode 25 against the channel walls is prevented. The thicknesses of 14' and 25 are between 100 and 1000 millimicrons, although this range is not critical. However, layer 24 should for reasons of dielectric breakdown be chosen between approximately 1 and 5 microns, depending largely upon the diameter of the channels. However, neither this range, nor any other design parameter set forth herein is critical.

From the foregoing, it will be appreciated that control electrode 25 will suppress emission of slow electrons from the output side of the multiplier 21. The spreading effect of the electron lens normally produced as in FIG. 1 is, thus nulified. Slow electrons normally spread more than fast electrons because the lens field has more time in which to move and to increase the transverse velocities of the slow electrons. Thus, slow electrons normally tend to spread substantially beyond the diameter of a channel by the time they hit the phosphor. This spreading action is eliminated in accordance with the present invention because control electrode 25 suppresses the emission of slow electrons altogether. Resolution is thus improved.

It is another advantage of the present invention that optimum resolution is easily obtained with the adjustment potential on control electrode 25.

It is another advantage of the invention that the saturation level of a channel-type electron multiplier is raised. For example, when the potential difference between electrodes 13' and 14' is raised from zero, the gain of the multiplier increases. However, beyond a predetermined potential difference, little additional gain is achieved. This is true because there is an insufficient supply of secondary electrons flowing to a position on the channel walls near the output ends thereof. In accordance with the present invention, this limiting condition, called saturation, is relieved by returning the slow electrons to the channel walls.

The gain control of a conventional channel-type electron multiplier, which is afforded by the adjustment of the potentials of electrodes 13 and 14, is limited because this control cannot be varied beyond limits determined by pattern noise. Thus, the device of the present invention has still another advantage in that the adjustable potential of control electrode 25 provides a second gain control which is independent of pattern noise.

What is claimed is:

1. An electron discharge device comprising: an evacuated envelope; a channel-type electron multiplier in said envelope, said multiplier including a dielectric plate having holes therethrough; first means to supply primary electrons to said holes on one side of said plate, the plate surfaces defining said holes being adapted to produce a secondary emission ratio greater than unity, said multiplier having a conductive input electrode on said one side thereof, said multiplier having a conductive output electrode on the other side thereof, a conductive control electrode isolated from the plate of said multiplier and adjacent the said output electrode, all of said electrodes having holes therethrough in registration with said plate holes to provide free and open communication through said plate holes; second means to receive the electron output of said multiplier; and a source of potential to maintain said electrodes at different DC potentials, said source maintaining said output electrode at a potential more positive than said input electrode and at a potential more positive than said control electrode.

2. The invention as defined in claim 1, wherein said third means includes an electrical lead for each electrode, said leads being fixed through said envelope and connected to a corresponding electrode.

3. The invention as defined in claim 1, wherein said envelope is transparent, said first means including a photocathode fixed in said envelope, said second means including a phosphor screen fixed in said envelope, said source of potential maintaining said input electrode positive with respect to said photocathode, said output electrode positive with respect to said input electrode, said control electrode only slightly negative with respect to said output electrode and substantially positive with respect to said input electrode, and said screen positive with respect to all of said electrodes, said electrodes being vapor deposited layers, said multiplier including a vapor-positioned dielectric layer between said output and control electrodes, said dielectric layer also having holes therethrough in registration with said multiplier plate holes, and means to adjust the potential of said control electrode.

4. The invention as defined in claim 1, wherein said source includes means to maintain said output electrode positive with respect to said input electrode and to maintain said control electrode negative with respect to said output electrode and positive with respect to said input electrode.

5. The invention as defined in claim 4, wherein said control electrode potential is only slightly less than said output electrode potential and substantially greater than said input electrode potential.

6. The invention as defined in claim 5, wherein all of said electrodes are conductive layers, said input and output electrodes being fixed to said multiplier plate, said multiplier including a dielectric layer fixed to the outside of said output electrode, said control electrode being fixed to said dielectric layer, said dielectric layer also having holes therethrough in registration with those of said plate.

7. The invention as defined in claim 6, wherein all of said layers are evaporated layers.

8. The invention as defined in claim 4, wherein all of said electrodes are conductive layers, said input and output electrodes being fixed to said multiplier plate, said multiplier including a dielectric layer fixed to the outside of said output electrode, said control electrode being fixed to said dielectric layer, said dielectric layer also having holes therethrough in registration with those of said plate.

9. The invention as defined in claim 8, wherein all of said layers are evaporated layers.

* * * * *